US007617959B2

(12) United States Patent
Yang

(10) Patent No.: US 7,617,959 B2
(45) Date of Patent: Nov. 17, 2009

(54) ADJUSTING DEVICE FOR A NAIL GUN

(75) Inventor: Brad Yang, Tali (TW)

(73) Assignee: Testo Industry Corp., Taichung Hsien (TW)

( * ) Notice: Subject to any disclaimer, the term of this patent is extended or adjusted under 35 U.S.C. 154(b) by 103 days.

(21) Appl. No.: 12/021,822

(22) Filed: Jan. 29, 2008

(65) Prior Publication Data

US 2009/0188963 A1 Jul. 30, 2009

(51) Int. Cl.
*B25C 1/04* (2006.01)

(52) U.S. Cl. ..... 227/137; 227/120; 227/136

(58) Field of Classification Search ..... 227/120, 227/136, 137, 109, 128
See application file for complete search history.

(56) References Cited

U.S. PATENT DOCUMENTS 3,568,908 A * 3/1971 Bader ..... 227/127
3,945,551 A * 3/1976 Sato et al. ..... 227/136
4,518,109 A * 5/1985 Shiroyama ..... 227/109
4,600,135 A * 7/1986 Mukoyama ..... 227/120
5,683,024 A * 11/1997 Eminger et al. ..... 227/8
6,152,346 A * 11/2000 Laubach ..... 227/109
7,232,051 B2 * 6/2007 Huang et al. ..... 227/120

* cited by examiner

*Primary Examiner*—Louis K. Huynh
*Assistant Examiner*—Nathaniel Chukwurah
(74) *Attorney, Agent, or Firm*—Apex Juris, pllc; Tracy M Heims

(57) ABSTRACT

An adjusting device for a nail gun includes a magazine, a shaft, a disc feeder and a positioning assembly. The shaft is mounted in the magazine and has two sliding grooves longitudinally formed respectively in the shaft and multiple positioning recesses formed on the sliding grooves. The disc feeder includes a rotating disc and a sleeve mounted around the shaft and has two mounting holes each corresponding to a positioning recess. The positioning assembly includes a clamp and an E-clip having two stops. The clamp is mounted in the sleeve and has two clamping arms each having a boss. The stops are mounted respectively in the mounting holes, respectively abutting the clamping arms and held by the E-clip. Therefore the magazine can be adjusted in one direction at multiple stages by pulling up and in the other direction by pressing the clamp that releases the stops for easy adjustment.

10 Claims, 7 Drawing Sheets

ADJUSTING DEVICE FOR A NAIL GUN

BACKGROUND OF THE INVENTION

1. Field of Invention

The present invention relates to a nail gun, and more particularly to an adjusting device for a nail gun.

2. Description of the Related Art

A conventional nail gun has a magazine having a shaft and a disc feeder. The disc feeder is mounted on the shaft with a positioning protrusion and a positioning groove. The disc feeder can move between two stages to allow the magazine to be loaded with different lengths of nails.

However, when adjusting between the stages of the disc feeder, the disc feeder must be rotated, adjusted, then rotated again. Accordingly, adjusting the nail gun disc is laborious and time-consuming.

To overcome the shortcomings, the present invention provides an adjusting device for a nail gun to mitigate or obviate the aforementioned problems.

SUMMARY OF THE INVENTION

The primary objective of the present invention is to provide an adjusting device for a nail gun that allows easy adjustment of the disc feeder.

An adjusting device for a nail gun includes a magazine, a shaft, a disc feeder and a positioning assembly. The shaft is mounted in the magazine and has two sliding grooves longitudinally formed respectively in the shaft and multiple wedge shaped positioning recesses formed on the sliding grooves. The disc feeder includes a rotating disc and a sleeve mounted around the shaft and has two mounting holes each corresponding to a positioning recess. The positioning assembly includes a clamp and an E-clip holding two stops. The clamp is mounted in the sleeve and has two clamping aims. The slops are mounted respectively in the mounting holes respectively abutting the clamping arms. Therefore the magazine can be adjusted in one direction at multiple stages by pulling up thereby allowing the stops to slide rip the wedge shaped positioning recess and over an apex of the wedge shaped positioning recess. To push in the other direction the clamp is pressed to release the stops from the positioning recesses and allowing the sleeve to move past a base of the wedge shaped positioning recesses.

Other objectives, advantages and novel features of the invention will become more apparent from the following detailed description when taken in conjunction with the accompanying drawings.

DETAILED DESCRIPTION OF THE INVENTION

Figure 1:
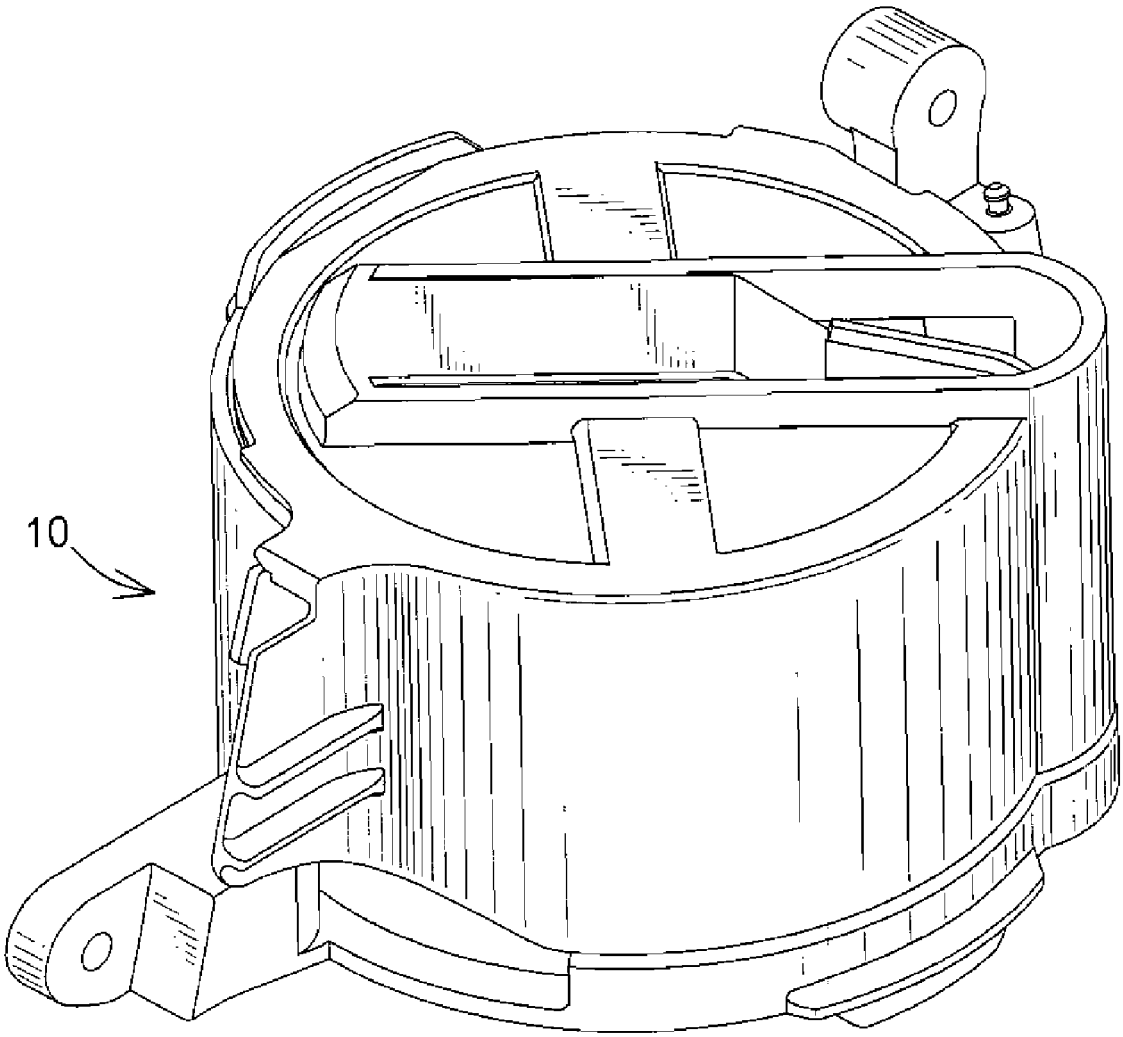
FIG. 1 is a perspective view of an adjusting device for a nail gun in accordance with the present invention.
Figure 2:
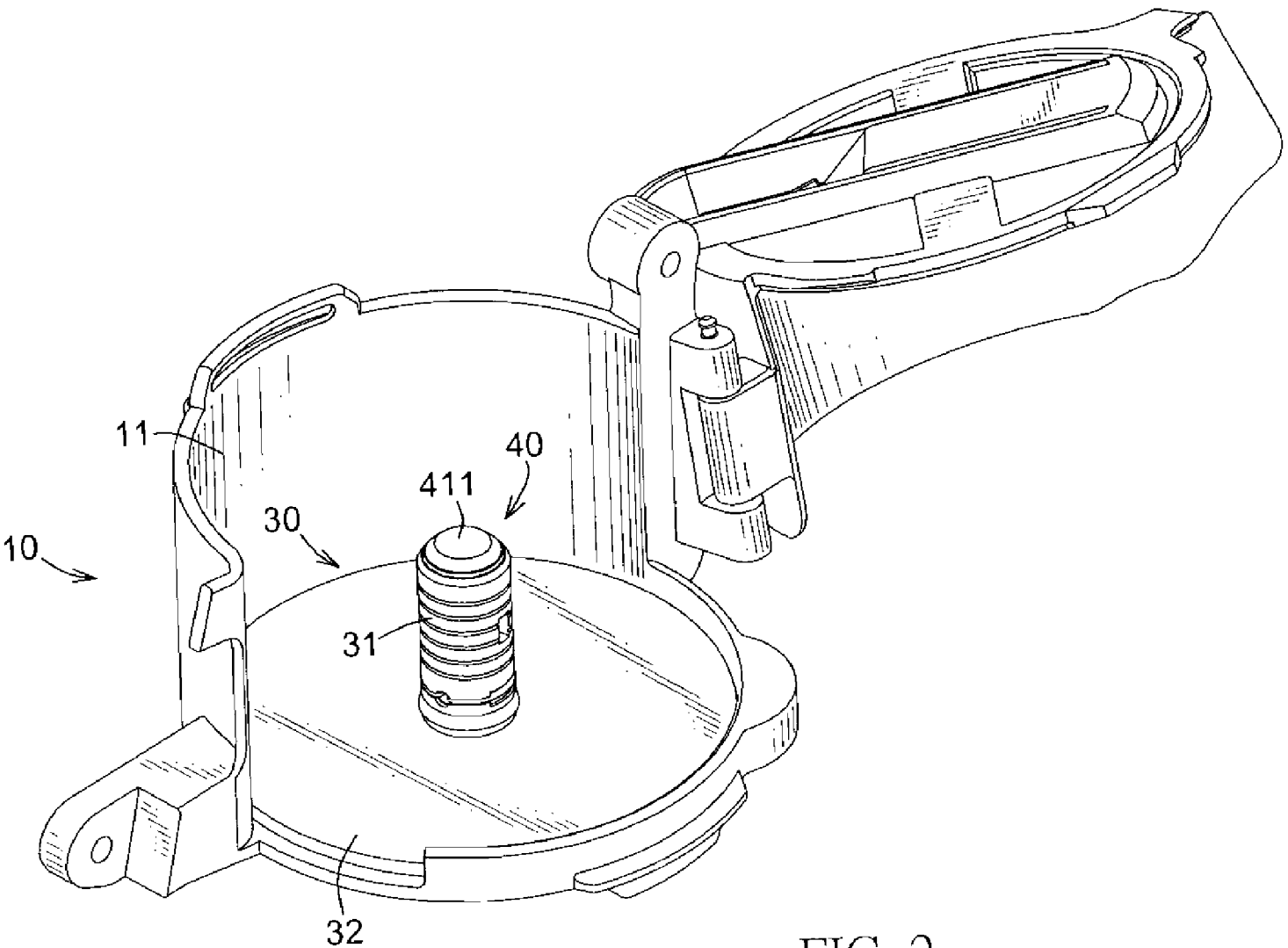
FIG. 2 is a perspective view of the adjusting device for a nail gun in FIG. 1 with the magazine being open.
Figure 3:
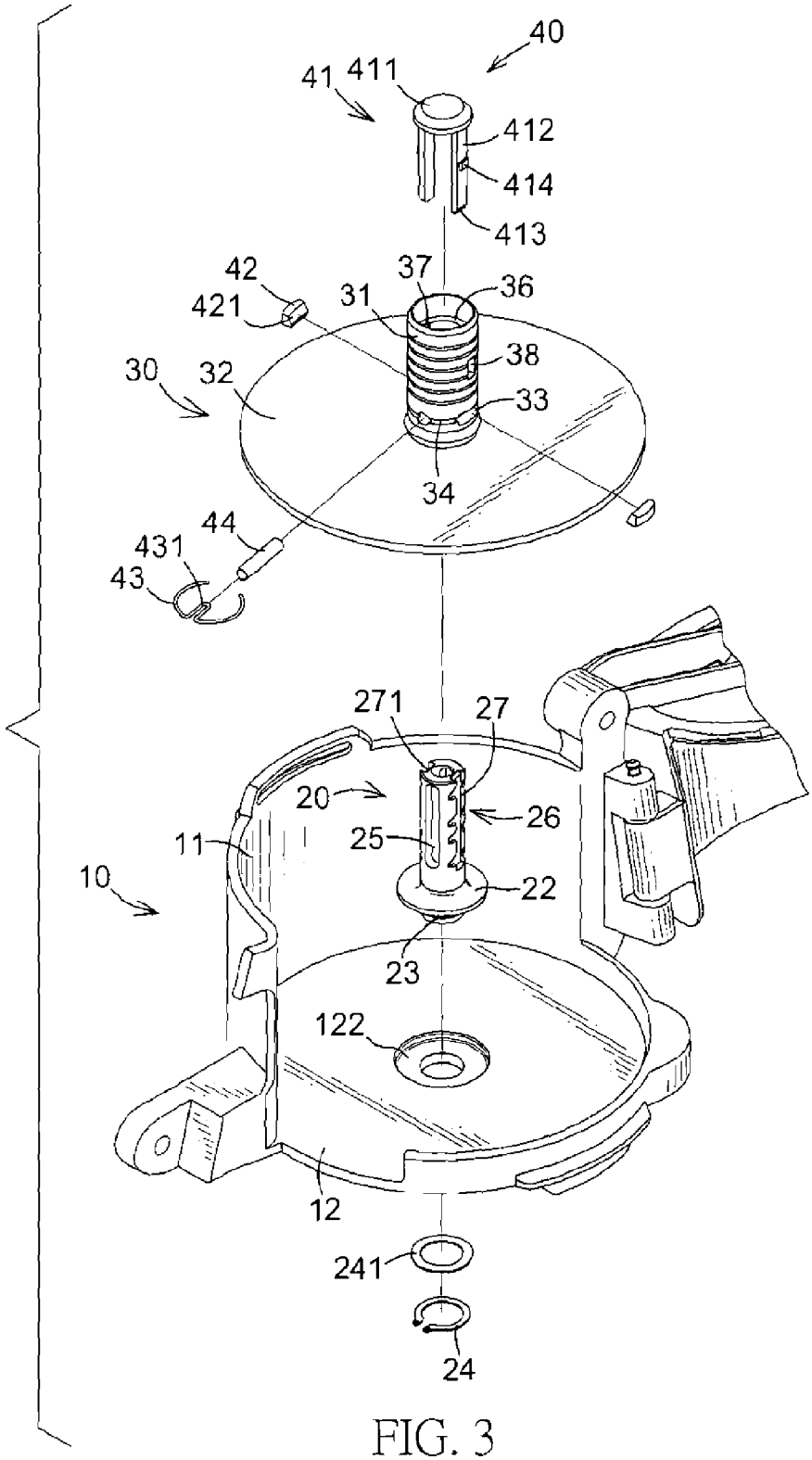
FIG. 3 is an exploded perspective view of the adjusting device for a nail gun in FIG. 2.

With reference to FIGS. 1 to 3, an adjusting device for a nail gun in accordance with the present invention comprises a magazine (10), a shaft (20), a disc feeder (30) and a positioning assembly (40).

The magazine (10) is cylindrical and hollow and has a hinged outer wall, a receiving chamber (11) and a base disc (12). The base disc (12) has an inner surface, an outer surface and an annular recess (122). The annular recess (122) is defined in the inner surface of the base disc (12).

Figure 4:
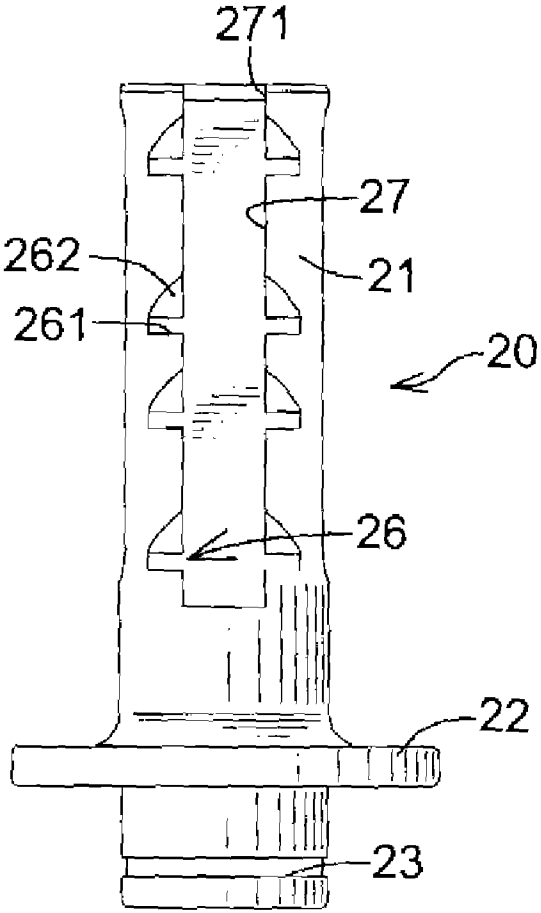
FIG. 4 is a side view of a sleeve of the adjusting device for a nail gun in FIG. 3.
Figure 5:
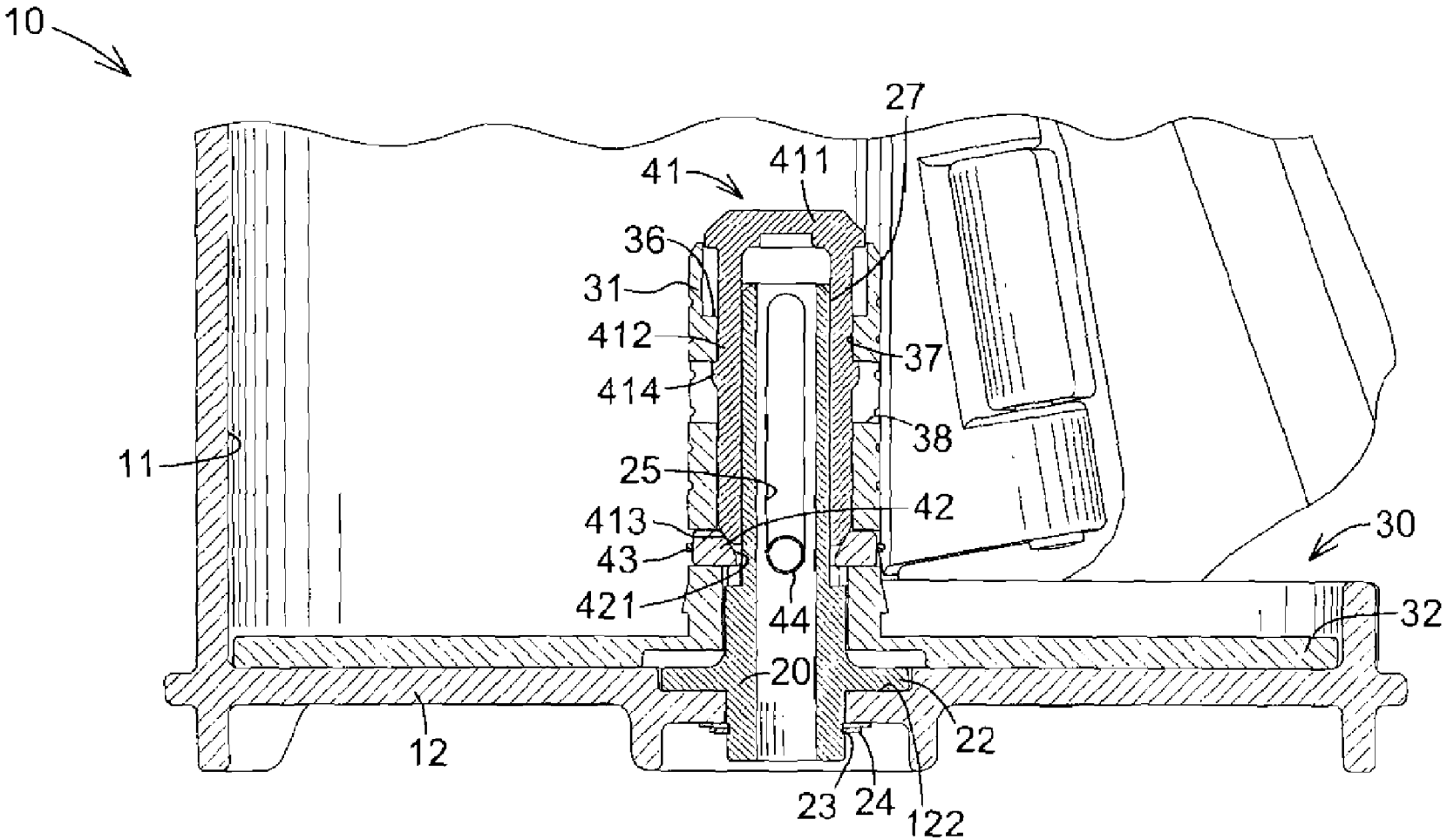
FIG. 5 is an enlarged cross-sectional side view of the adjusting device for a nail gun in FIG. 2.

With further reference to FIGS. 4 and 5, the shaft (20) is mounted centrally through the base disc (12) of the magazine (10) and in the annular recess (122) and has a proximal end, a distal end, an outer surface, an annular flange (22), an annular groove (23), a circlip (24), a washer (241), two positioning slots (25), multiple pairs of positioning recesses (26) and two sliding grooves (27). The proximal end of the shaft (20) is mounted rotatably through the base disc (12) and protrudes from the outer surface of the base disc (12). The annular flange (22) is formed near the proximal end of the shaft (20) and is mounted in the annular recess (122) of the base disc (12) to hold the shaft (20) in the magazine (10). The annular groove (23) is formed around the proximal end of the shaft (20) outside the magazine (10). The circlip (24) is mounted in the annular groove (23) to hold the shaft (20) in the magazine (10). The washer (241) is mounted between the outer surface of the base disc (12) and the circlip (24) to allow easy rotation of the shaft (20) relative to the magazine (10).

The positioning slots (25) are respectively defined longitudinally in the shaft (20) diametrically and parallelly to each other. The sliding grooves (27) are respectively defined longitudinally in the shaft (20) diametrically and parallelly to each other and each sliding groove (27) has a distal opening (271). Each pair of positioning recesses (26) are defined diametrically in the shaft (20) respectively along a corresponding sliding groove (27). Preferably, four pairs of positioning recesses (26) are implemented. Each positioning recess (26) is an inverted wedge having a base (261), an apex (262) and a depth. The base (261) of each wedge is disposed toward the disc base (12). The apex (262) of each wedge is aligned centrally on the corresponding sliding groove (27) and has a guide incline. The depth of the positioning recess (26) is greater at the base (261) than the apex (262).

The disc feeder (30) is mounted around the shaft (20) and comprises a sleeve (31) and a rotating disc (32). The sleeve (31) is mounted around the shaft (20) and has a distal end, a proximal end, an inner surface, two mounting holes (33), a mounting groove (34), a mounting shoulder (36), two guiding grooves (37) and two wedging holes (38). The mounting holes (33) are respectively defined diametrically through the sleeve (31) near the proximal end of the sleeve (31) and each selectively corresponds to a positioning recess (26). The mounting groove (34) is defined around the proximal end of the sleeve (31) and through the mounting holes (33).

The mounting shoulder (36) is defined in the inner surface of the sleeve (31) at the distal end of the sleeve (31). The guiding grooves (37) are respectively, longitudinally defined diametrically in the inner surface of the sleeve (31) and correspond respectively to the sliding grooves (27) in the shaft (20) and may be formed through the mounting shoulder (36). The wedging holes (38) are respectively defined through the sleeve (31) and communicate respectively with the guiding grooves (37). The rotating disc (32) is formed on and protrudes radially from the proximal end of the sleeve (31).

The positioning assembly (40) is mounted between the shaft (20) and the sleeve (31) and comprises a clamp (41), an E-clip (43) and a positioning rod (44). The clamp (41) has a button (411) and two clamping arms (412). The button (411) may be circular, is mounted in the distal end of the sleeve (31), may be above the mounting shoulder (36), and has an outer surface and an inner surface. The outer surface of the button (41) protrudes out of the distal end of the sleeve (31). The clamping arms (412) are formed on and protrude from the inner surface of the button (411), are respectively mounted slidably in the guiding grooves (37) in the sleeve (31) and in the sliding grooves (27) in the shaft (20) and each clamping arm (412) has a distal end, an outer surface, a sliding incline (413) and a boss (414). The sliding incline (413) is defined at the distal end of the clamping arm (41) and is selectively disposed adjacent to a corresponding mounting hole (33) in the sleeve (31). The boss (414) is formed on the outer surface of the clamping arm (412) and is mounted in a corresponding wedging hole (38) in the sleeve (31).

The positioning rod (44) is mounted through the sleeve (31) and through the positioning slots (25) in the shaft (20) to prevent rotation of the sleeve (31) relative to the shaft (20). The E-clip (43) is mounted in the mounting groove (34) in the sleeve (31) and has a central segment, an inner protrusion (431) and two stops (42). The inner protrusion (431) is formed on the central segment and is mounted in the positioning rod (44). The stops (42) are mounted respectively in the mounting holes (33) in the sleeve (31), are disposed adjacent to the E-clip (43) and may be blocks or protrusions formed on the E-clip (43) and each stop (42) has an inner end having a push incline (412) formed thereon and abutting the sliding incline (413) of a corresponding clamping arm (412).

When the adjusting device is in use, the magazine (10) is mounted on a nail gun. A clip of nails is loaded into the receiving chamber (11) of the magazine (10) around the sleeve (31) and abuts the rotating disc (32). Therefore, the nails can be transferred continuously to the nail gun by rotation of die disc feeder (30).

Figure 6:
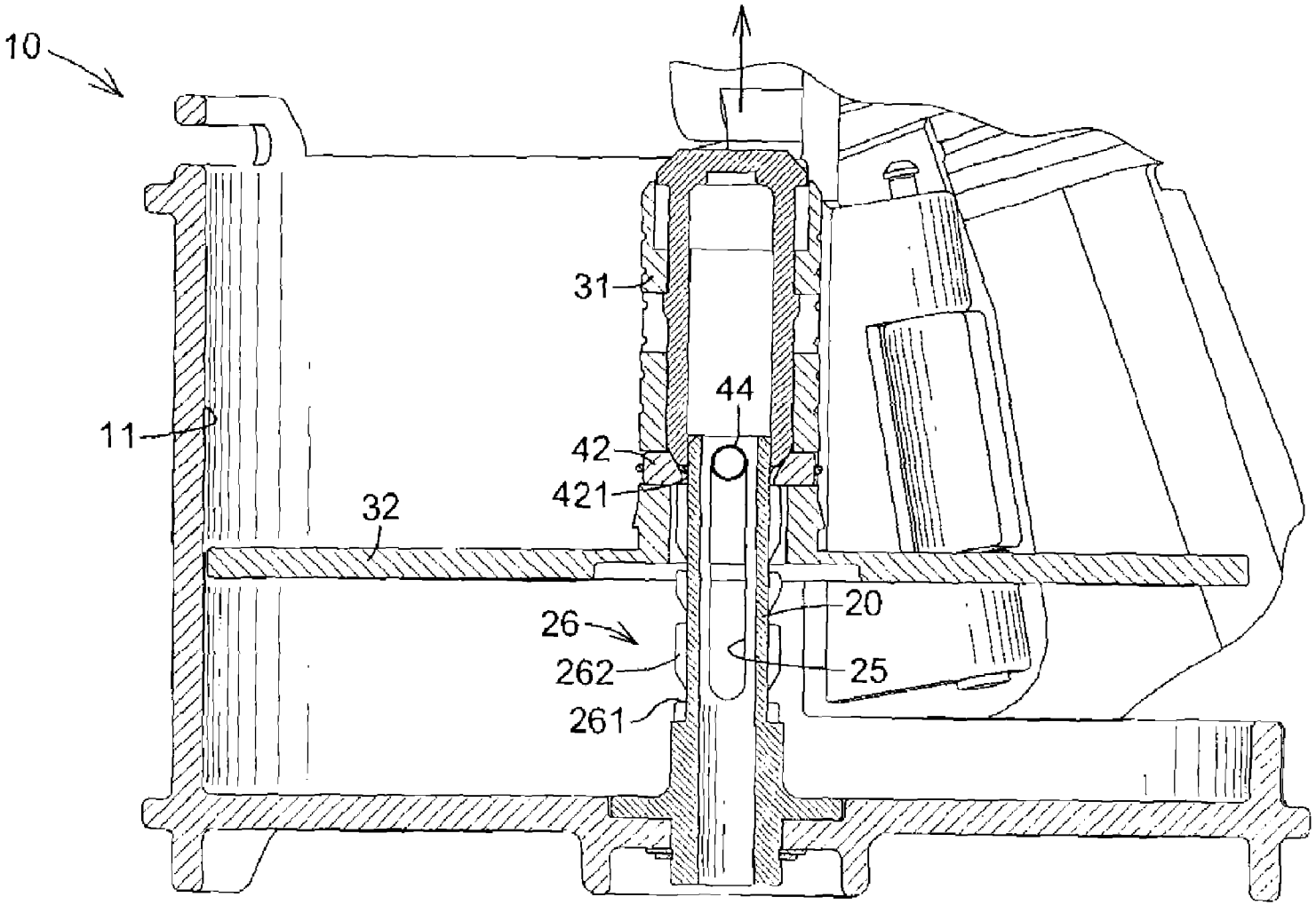
FIG. 6 is an operational cross-sectional side view of the adjusting device for a nail gun in FIG. 5, with the disc feeder shown sliding up.

When the clip of nails is loaded in the magazine (10), the disc feeder (30) can be slid up and down to selectively fit different length of nails. With further reference to FIG. 6, When the nails are short relative to a depth of the magazine (10), the disc feeder (30) is slid up to shorten the depth of the magazine (10). Because each positioning recess (26) has the apex (262) with the guide incline, the disc feeder (30) can be slid up easily, merely by pulling up the sleeve (31).

When the sleeve (31) is pulled up, the stops (42) are moved toward the apexes (262) of the pair of positioning recesses (26) before being forced into another pair of positioning recesses (26) by the E-clip (43). Engagement between the bases (261) of the positioning recesses (26) and the stops (42) means the stops (42) are held securely by the positioning recesses (26) even when the sleeve (31) is pulled down. Additionally, because multiple pairs of positioning recesses (26) are defined in the shaft (31), the disc feeder (30) can be adjusted at multiple stages to correspond to different lengths of nails.

Figure 7:
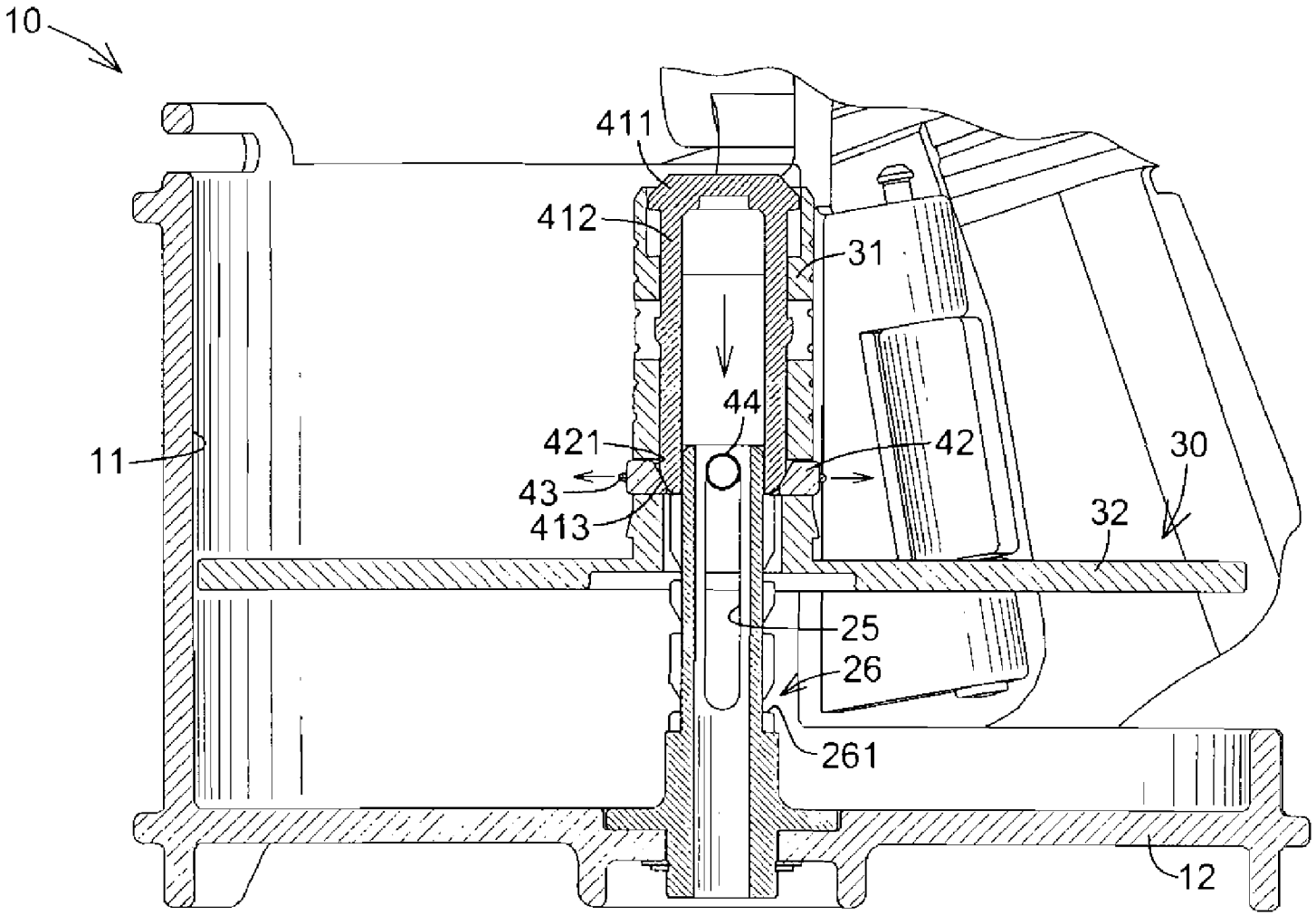
FIG. 7 is an operational cross-sectional side view of the adjusting device for a nail gun in FIG. 5, with the disc feeder shown sliding down.

With further reference to FIG. 7, when the nails are long relative to the depth of the magazine (10), the button (411) of the clamp (41) is pushed down and the clamping arms (412) move down and the sliding inclines (413) in the clamping arms (412) respectively press against the push inclines (421) of the stops (42). Then the stops (42) move outwards and leave the corresponding pair of positioning recesses (26). Therefore, the disc feeder (30) can move down until a required depth of magazine (10) is attained.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjusting device for a nail gun comprising a magazine having a base disc;

a shaft being mounted centrally through the base disc and having an outer surface;

a proximal end being mounted rotatably through the base disc and protruding from the inner surface of the base disc;

a distal end;

two positioning slots being respectively defined longitudinally in the shaft, diametrically and parallelly to each other;

two sliding grooves being respectively defined longitudinally in the shaft, diametrically and parallelly to each other and each having a distal opening; and multiple pairs of positioning recesses, each pair of positioning recesses being defined diametrically in the shaft respectively along one of the slide grooves and each positioning recess being an inverted wedge, the inverted wedge having a base being disposed toward the disc base;

an apex being aligned centrally on a corresponding sliding groove and having a guide incline; and a depth being greater at the base than the apex;

a disc feeder being mounted around the shaft and comprising a sleeve being mounted around the shaft and having a distal end;

a proximal end;

an inner surface;

two mounting holes being respectively defined through the sleeve and each selectively corresponding to one of the positioning recesses;

a mounting groove being defined around the proximal end of the sleeve and through the mounting holes;

two guiding grooves being respectively defined longitudinally and diametrically in the inner surface of the sleeve and corresponding respectively to the sliding grooves in the shaft; and two wedging holes being respectively defined through the sleeve and communicating respectively with the guiding grooves; and a rotating disc being formed on and protruding radially from the proximal end of the sleeve; and a positioning assembly being mounted between the shaft and the sleeve and comprising a clamp having a button being mounted in the distal end of the sleeve and having an outer surface protruding from the top end of the sleeve; and an inner surface; and two clamping arms being formed on and protruding from the inner surface of the button, being respectively mounted slidably in the guiding grooves in the sleeve and in the sliding grooves in the shaft and each clamping arm having a distal end;

an outer surface;

a sliding incline being defined at the distal end of the clamping arm and being disposed adjacent to a corresponding mounting hole in the sleeve; and a boss being formed on the outer surface of the clamping arm and being mounted in a corresponding wedging hole in the sleeve; and an E-clip being mounted in the mounting groove in the sleeve and having two stops being mounted respectively in the mounting holes in the sleeve and each having an inner end having a push incline formed thereon and abutting the sliding incline of a corresponding clamping arm.

2. The adjusting device for a nail gun as claimed in claim 1, wherein the base disc further has an inner surface, an outer surface and an annular recess being defined in the outer surface of the base disc;

the shaft further has an annular flange being formed near the proximal end of the shaft and being mounted in the annular recess of the base disc;

an annular groove being formed around the proximal end of the shaft and disposed outside of the magazine;

a circlip being mounted in the annular groove; and two positioning slots being respectively defined longitudinally in the shaft, diametrically and parallelly to each other; and the positioning assembly further comprises a positioning rod mounted through the sleeve and through the positioning slots in the shaft.

3. The adjusting device for a nail gun as claimed in claim 2, wherein the sleeve further has a mounting shoulder defined in the inner surface of the sleeve at the distal end of the sleeve, the guiding grooves are further formed through the mounting shoulder; and the button is mounted above the mounting shoulder.

4. The adjusting device for a nail gun as claimed in claim 3, wherein the shaft further has a washer mounted between the outer surface of the base disc and the circlip.

5. The adjusting device for a nail gun as claimed in claim 4, wherein the E-clip has a central segment and an inner protrusion formed at the central segment and mounted in the positioning rod.

6. The adjusting device for a nail gun as claimed in claim 5, wherein the shaft has four pairs of positioning recesses.

7. The adjusting device for a nail gun as claimed in claim 2, wherein the shaft further a washer mounted between the outer surface of the base disc and the circlip.

8. The adjusting device for a nail gun as claimed in claim 2, wherein the E-clip has a central segment and an inner protrusion formed at the central segment and mounted in the positioning rod.

9. The adjusting device for a nail gun as claimed in claim 1, wherein the sleeve further has a mounting shoulder defined in the inner surface of the sleeve at the distal end of the sleeve;

the guiding grooves are further formed through the mounting shoulder; and the button is mounted above the mounting shoulder.

10. The adjusting device for a nail gun as claimed in claim 1, wherein the shaft has four pairs of positioning recesses.

* * * * *